US005401315A

United States Patent [19]

Salo et al.

[11] Patent Number: 5,401,315

[45] Date of Patent: Mar. 28, 1995

[54] METHOD AND DEVICE IN A SIZE PRESS

[75] Inventors: Markku Salo, Muurame; Ari Rousu, Jyväskylä, both of Finland

[73] Assignee: Valmet Paper Machinery, Inc., Helsinki, Finland

[21] Appl. No.: 45,637

[22] Filed: Apr. 9, 1993

[30] Foreign Application Priority Data

Apr. 10, 1992 [FI] Finland ..... 921631

[51] Int. Cl.[6] ..... B05C 1/00

[52] U.S. Cl. ..... 118/225; 118/256; 118/255

[58] Field of Search ..... 118/126, 261, 413, 226, 118/255, 256, 258, 262, DIG. 15, 225

[56] References Cited

U.S. PATENT DOCUMENTS

| | | | |
|---|---|---|---|
| 4,495,886 | 1/1985 | Phelps | 118/262 |
| 4,524,712 | 6/1985 | Ito | 118/262 |
| 5,108,794 | 4/1992 | Kinnunen | 427/356 |
| 5,167,755 | 12/1992 | Zodrow et al. | 118/258 |

FOREIGN PATENT DOCUMENTS 85895 2/1992 Finland .

*Primary Examiner*—James C. Housel

*Assistant Examiner*—Rachel Freed

*Attorney, Agent, or Firm*—Steinberg, Raskin & Davidson

[57] ABSTRACT

A device in a size press comprising a nip formed by press rolls through which a paper or board web is passed. The press rolls are provided with coating devices for spreading films of a coating agent onto faces of the press rolls. The coating devices are mounted on applicator beams arranged transverse to the machine direction. The applicator beams are supported pivotally on the frame of the size press or on the loading arms of a displaceable press roll and are provided with pivot cylinders by which the applicator beams can be opened and closed in relation to the rolls corresponding to them. The applicator beams are further provided with catches supported directly or indirectly on bearings of the corresponding press rolls when the applicator beams are being closed by the pivot cylinders. At least one of the applicator beams of the size press is provided with catches at each end of the applicator beam and positioned in accordance with the position of the applicator beam. The catches are attached to the applicator beam by articulated joints and are interconnected mechanically.

19 Claims, 5 Drawing Sheets

METHOD AND DEVICE IN A SIZE PRESS

BACKGROUND OF THE INVENTION

The present invention relates to a method and device in a size press in which a nip is formed by a pair of press rolls. A paper or board web is passed through the nip. A first press roll is permanently mounted, or fixed, by means of bearings on a frame of the size press, while a second press roll is mounted on the frame of the size press by means of additional bearings. The second press roll is displaceable by means of loading arms or equivalent loading means. The press rolls are coated by means of coating devices which spread films of a coating agent onto the faces of the rolls. The coating devices are mounted on applicator beams arranged transverse to the machine direction. The applicator beams are supported pivotally on the frame of the size press or on the loading arms of the displaceable roll and are provided with pivot cylinders. By means of the pivot cylinders, the applicator beams can be opened and closed in relation to corresponding press rolls against which the coating devices operate. In addition, the applicator beams are provided with catches arranged to be supported directly or indirectly on the bearings of corresponding rolls when the applicator beams are being closed by means of the pivot cylinders.

In the prior art, it is a typical construction of modern size presses that the size press comprises a pair of rolls which form a nip through which a paper or board web is passed. A coating agent, such as a size or pigment coating, is applied as a film onto the faces of the rolls by means of application devices. The coating agent is transferred onto the web to be coated in the roll nip. Normally, one roll in the pair of rolls is permanently mounted, i.e. fixed, on the frame of the size press by means of bearings, whereas the other roll is mounted on the frame displaceably, e.g., by means of pivot arms. The pivot arms permit the nip to be opened and the press roll to be loaded against one another so as to produce a desired nip pressure.

A significant disadvantage of the size-press construction described above is manifested in particular in connection with the replacement of the rolls. In particular, when the fixed roll is replaced, the new roll is not always positioned optimally on the frame of the size press, rather it may remain slightly inclined. When the nip is closed, the displaceable roll is positioned in a way corresponding to the fixed roll to produce a uniform nip pressure. Thus, the displaceable roll is also positioned in an inclined manner in a way corresponding to the fixed roll.

The application devices of the rolls are typically mounted on an applicator beam arranged transverse to the machine direction. The applicator beam is linked pivotally on the frame of the size press or on the loading arm of the displaceable roll. The applicator beam is usually provided with pivot cylinders, by whose means the beam and the coating device mounted on the beam are "closed" against the corresponding roll, i.e. to form a nip. However, the construction of the applicator beam is very rigid, for which reason it cannot always be positioned by means of its pivot cylinders in a manner corresponding to the positions of the rolls.

An applicator beam is generally provided with mechanical catches, which rest against catch faces formed on the bearing housings of the roll when the beam is closed. If the roll has been positioned in a highly inclined position, upon closing of the beam, a situation may arise in which the catch placed at one side of the beam only reaches contact with the bearing housing of the roll. Therefore, a gap remains between the catch placed at the opposite side and the catch face formed on the bearing housing. Even if the coating member of the coating device could be placed correctly against the roll face, by means of its loading hose, the pivot cylinders of the applicator beam usually produce an error in the nip pressure. This error is increased linearly in the transverse direction of the machine and has a highly detrimental effect on the coating result produced by the application devices on the press rolls.

Hydraulic catches have also been applied in applicator beams of size presses. In their simplest form, they consist of a hydraulic cylinder whose length can be adjusted, i.e., a "jack". By adjusting the length of the hydraulic cylinders, both ends of the applicator beam can be made to rest against the catch faces formed on the bearing housings of the roll. However, the drawbacks related to such a solution are similar to those of the mechanical catches described above, i.e., the regulation is difficult, because the two catches must be adjusted separately. The support forces of both of the catches would have to be adjusted equal in order to prevent the pivot cylinders of the applicator beam from producing an error in the nip pressure. More "advanced" hydraulic catches invariably involve complicated control and regulation circuits, which are also expensive. Also, hydraulic systems always involve an unpredictable risk of leakage.

OBJECTS AND SUMMARY OF THE INVENTION

An object of the present invention is to provide a solution by whose means the above drawbacks related to the prior art are avoided.

It is another object of the present invention to provide a new and improved size press by means of which an improved coating result is obtained.

It is yet another object of the present invention to provide a new and improved size press wherein the nip pressure of a pair of rolls in the size press can be regulated to control the thickness of the coating on the paper web or board passing through the nip.

In view of achieving these objects, and others, in the present invention, at least one of the applicator beams of the size press is provided with catches placed at each end of the applicator beam and positioned in accordance with the position of the applicator beam. The catches are attached to the applicator beam by means of articulated joints and are interconnected mechanically.

It is an important advantage of the present invention, when compared with the prior art devices, that the load of the size nip in the size press, i.e. the nip pressure, is substantially uniform and controlled. As a result, the thickness of the layer of the coating agent on the paper or board web to be coated can be made as desired across the width of the web. In comparison with hydraulic systems, a further advantage of the present invention is low cost and simplicity.

Briefly, the device in accordance with the invention includes a frame section having press rolls arranged thereon, and applicator beams arranged to operate against respective press rolls. At least one of the applicator beams has a first and second catch arranged at a first and second end thereof, respectively. The first and second catches are connected and attached to the at least one applicator beam by means of articulated joints and are arranged with respect to a desired position of the at least one applicator beam. Pivot cylinders are arranged between the frame and the applicator beams for pivoting the applicator beams between a closed position against a respective press roll and an open position away from the respective press roll.

The press rolls form a nip therebetween through which a paper web or board passed. A first press roll is fixed by means of bearings on the frame of the size press. A second press roll is mounted on the frame of the size press by means of additional bearings and is displaceable by loading means. The press rolls are coated by coating devices arranged to spread films of a coating agent onto the faces of the press rolls. The applicator beams can be supported on the frame of the size press or on the loading means of the second press roll.

In a preferred embodiment, the device includes supports rigidly connected to the bearings of the second press roll, and connecting means, i.e. an intermediate member, to connect both catches of the applicator beam. Each of the catches comprises a lever linked with the at least one applicator beam by means an articulated joint, and a cam arranged at one end of the lever such that the cam is supported during the closing of the applicator beam against a respective one of the supports. The intermediate member is arranged to connect both catches at an opposite end of the lever.

The method in accordance with the invention provides a substantially uniform pressure in a nip in a size press in which press rolls form the nip through which a paper or board web is passed. In the method, a pair of press rolls form a nip and coating devices are arranged to spread a coating agent onto faces of the press rolls. The coating devices having applicator beams arranged to operate against a respective press roll. At least one of the applicator beams is provided with a pair of lever-shaped catches at a first and second end thereof which are connected to each other. As such, a load is applied to one of the catches during a closing operation of the at least one applicator beam and causes the catch to pivot about a support. In this manner, the other catches will also be moved to rest against a corresponding support to thereby level the respective press roll and provide a substantially uniform nip pressure during a running operation of the size press.

Additional advantages and characteristic features of the invention will be ascertained from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
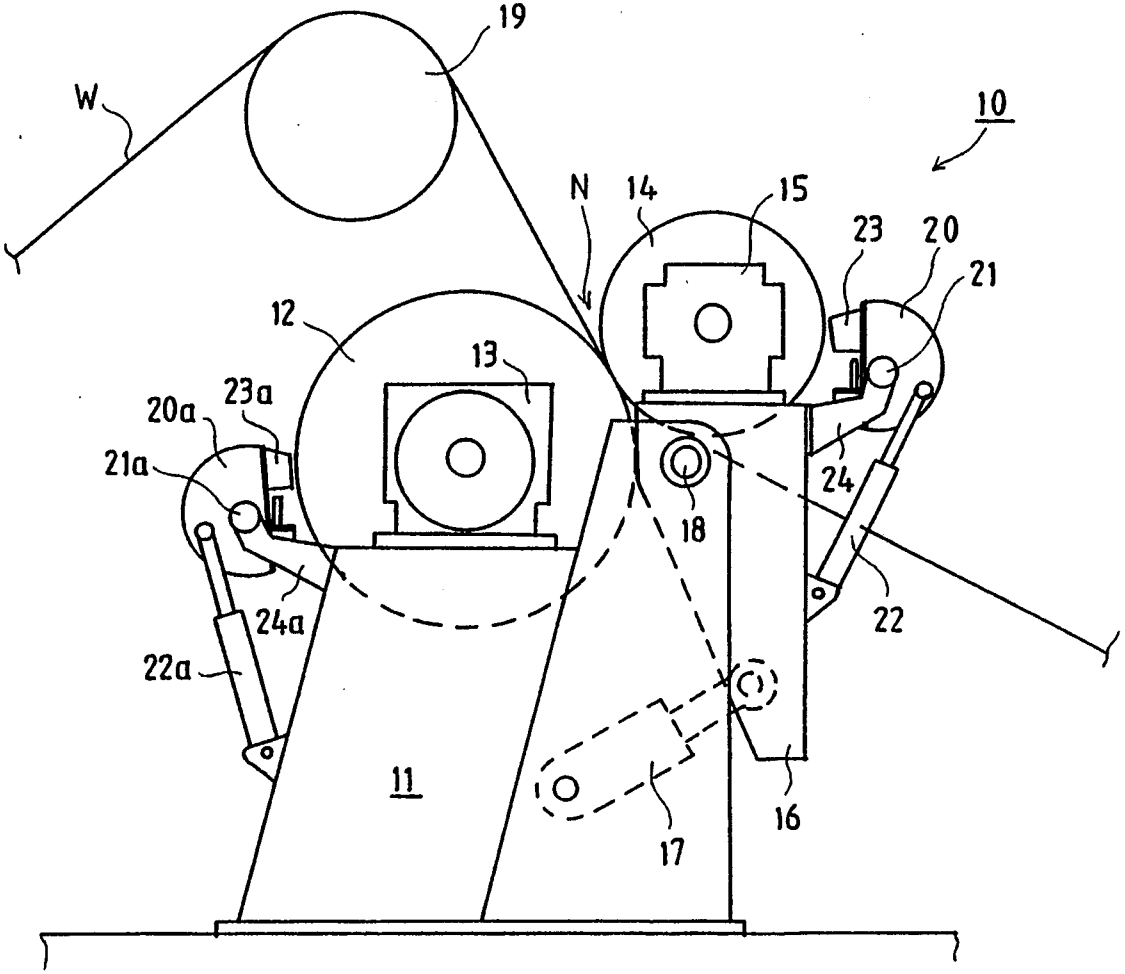
FIG. 1 is a fully schematic side view of a size press in which the device in accordance with the invention can be applied.

FIG. 1 is a schematic illustration of a size press which is denoted generally with the reference numeral 10. Press rolls 12,14 are arranged in the size press 10 and form a nip N with one another. A paper or board web W is passed through the nip N. In the embodiment shown in FIG. 1, the web W is passed into the nip N over a guide roll 19. A bearing 13 is connected to the first press roll 12 so that the first press roll 12 is permanently mounted, i.e. fixed, on the frame 11 of the size press. In a corresponding manner, a bearing 15 of the second press roll 14 is mounted on a loading arm 16, which is arranged on the frame 11 of the size press pivotally by means of an articulated joint 18. Loading cylinders 17 are arranged between the frame 11 and the loading arm 16. The loading cylinders 17 open and close the nip N and are arranged to adjust the loading pressure between the rolls 12,14, i.e. the nip pressure, to a desired level.

Each of the press rolls 12,14 in the size press 10 is provided with a coating device **23,23*a* of its own arranged to coat the respective roll. A film of coating agent is applied to the face of the respective roll 12,14 by the coating devices. The film is transferred onto the web W in the roll nip N. Each of the coating devices 23,23*a* is mounted on an applicator beam 20,20*a* arranged transverse to the machine direction. In the embodiment of FIG. 1, the applicator beam 20*a* of the first press roll 12 is mounted on holders 24*a* fixed to the frame 11 of the size press. The applicator beam 20*a* is arranged to pivot by means of an articulated joint 21*a*. Pivot cylinders 22*a* are arranged between the applicator beam 20*a* and the frame 11 of the size press. By means of the pivot cylinders 22*a*, the applicator beam 20*a* can be opened and closed in relation to the roll 12**.

In a corresponding manner, the coating device 23 of the second press roll 14 is mounted on an applicator beam 20 arranged transverse to the machine direction. Applicator beam 20 is mounted pivotally on holders 24 fixed to the loading arm 16 by means of an articulated joint 21. Pivot cylinders 22 are arranged between the applicator beam 20 and the loading arm 16. The applicator beam 20 can be opened and closed in relation to the second press roll 14 by means of the pivot cylinders 22.

When the rolls in a size press as illustrated in FIG. 1 have to be replaced, it is highly probable that the first roll, i.e. the fixed press roll 12, is probably not positioned exactly in the optimal, transverse position but rather has become slightly inclined. This situation is illustrated by means of the schematic diagram in FIG. 2, wherein the inclination of the first press roll 12 has been exaggerated considerably. When the first press roll 12 is inclined in the manner shown in FIG. 2, the second press roll 14 is, of course, also positioned at a similar inclination when the nip N is closed by means of the loading cylinders 17. Thus, equal forces are transmitted to the nip N from both loading cylinders 17 such that the forces produced by the loading cylinders 17 produce a substantially uniform nip pressure, i.e. a uniform distribution of loading pressure, in the nip N. This nip pressure is denoted in FIG. 2 with the reference $P_1$.

In the position in which the applicator beam 20 is linked on the frame 11 of the size press, the applicator beam 20 cannot be positioned diagonally in a similar way when it is closed by means of the pivot cylinders 22. This results, in particular, from the high rigidity of the applicator beam 20. If the applicator beam 20 is provided with conventional mechanical catches 40,41, when the beam 20 is closed, one catch 41 is loaded against the catch face formed on the bearing 15 of the press roll. In the worst case scenario, a gap c remains between the catch 40 placed at the opposite side of the machine and the catch face on the bearing 15. In such a case, the force produced by the pivot cylinder 22 at the end next to the gap c of the applicator beam 20 is transferred as a torque along the beam 20 to the other end of the beam and, from there, further to the loading arm 16. As a result, the nip force is increased by the amount $P_2$.

Figure 2:
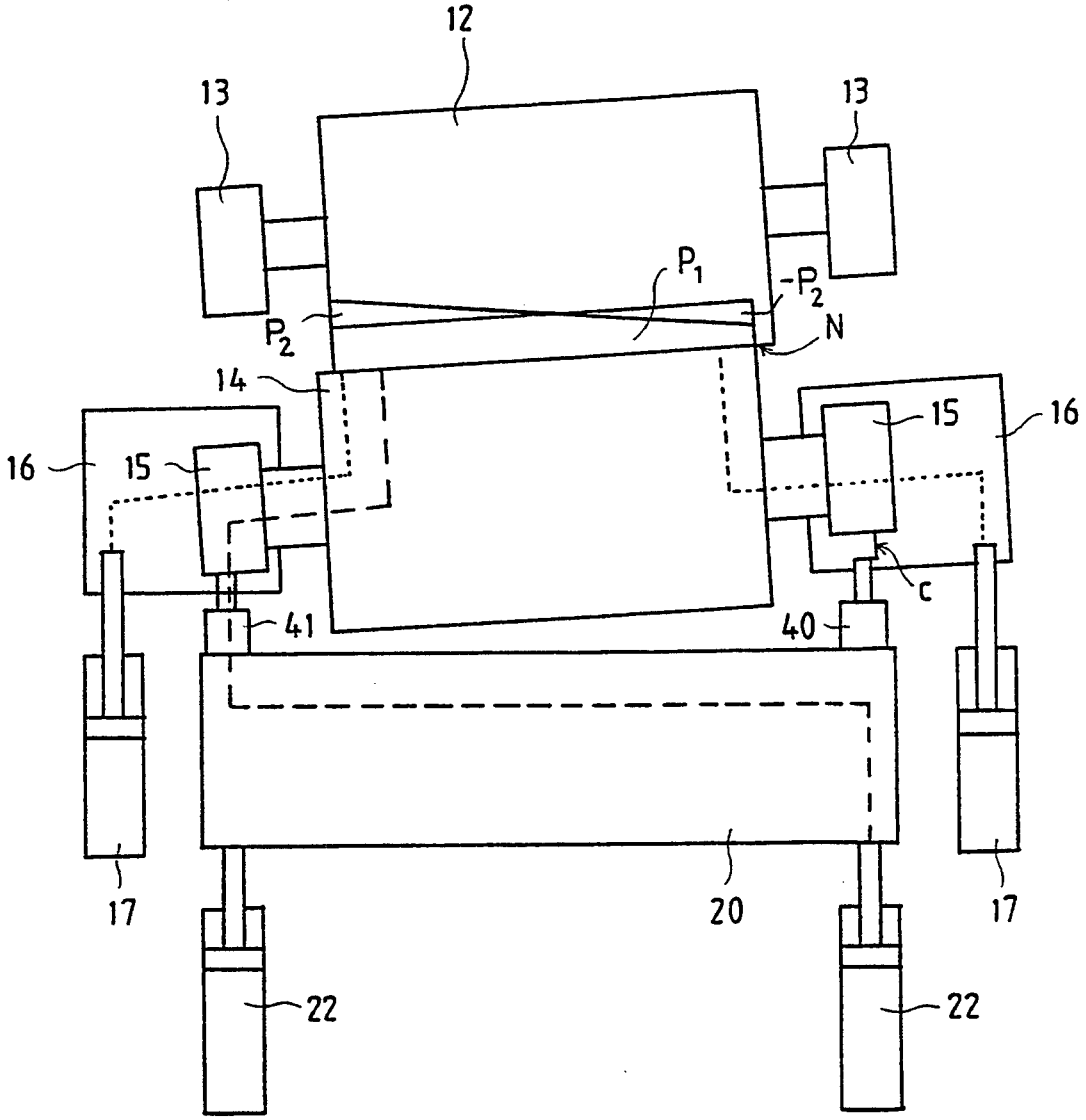
FIG. 2 PRIOR ART
FIG. 2 is a schematic top view of a size press showing the inclined positioning of the press rolls and a potential resulting error in the nip pressure.

In a corresponding manner, at the end next to the gap c, the force produced by the pivot cylinder 22 lowers the nip force by the amount $P_3$. In FIG. 2, the transfer of the forces is illustrated by the dashed lines. As a result of this reduction in the nip pressure, the pressure distribution $P_2$ produced by the pivot cylinders 22 of the applicator beam 20 in the nip N is not even. Rather, it changes, for example, in a linear curve as illustrated in FIG. 2. Thus, the nip pressure is, at one edge of the nip N, substantially higher than at the opposite edge. This has a considerably detrimental effect on the coating result of the press rolls.

Figure 3:
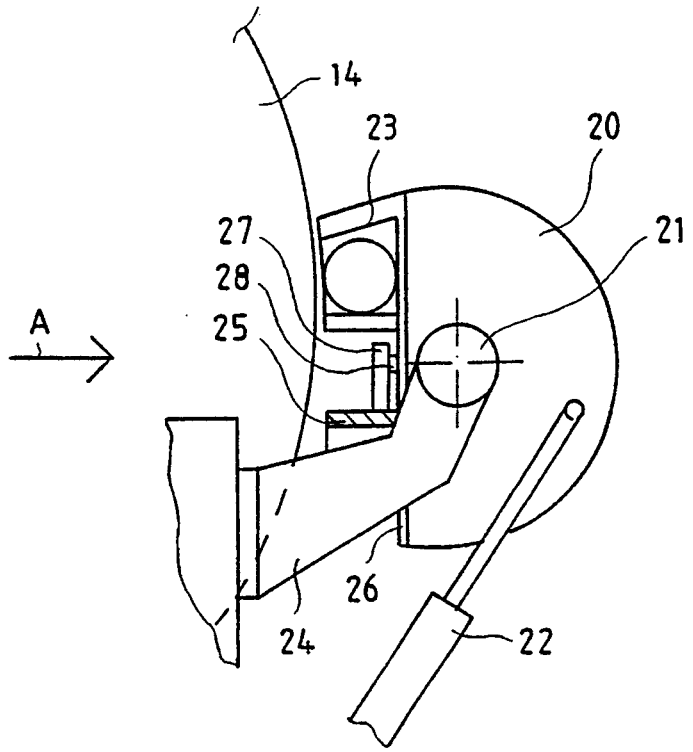
FIG. 3 is an enlarged detail of FIG. 1, illustrating the construction of the catches on the applicator beam in a device in accordance with the present invention.
Figure 4:
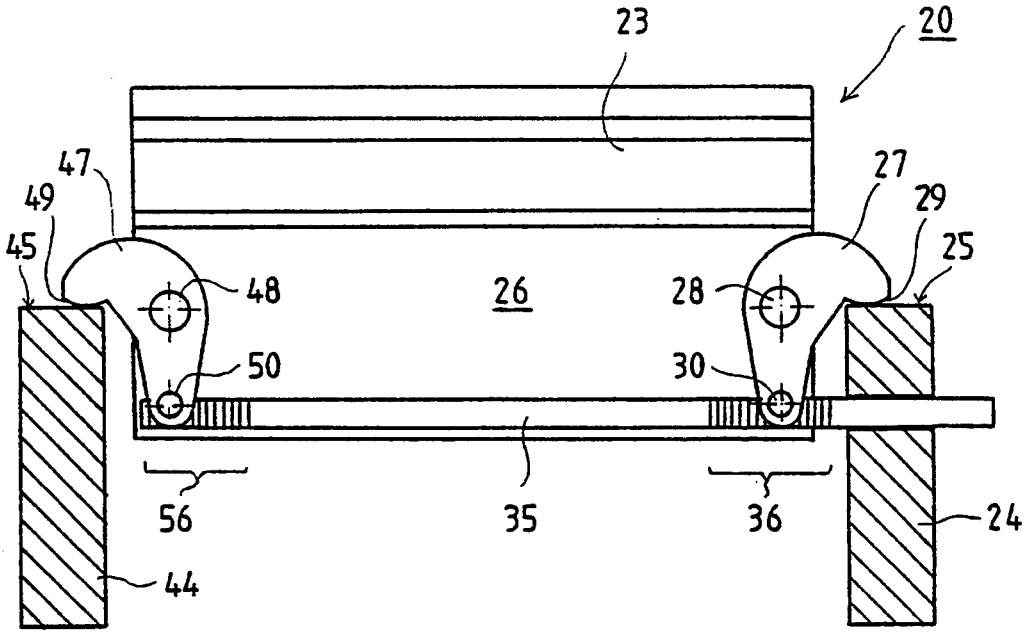
FIG. 4 is a view in the direction A of the construction illustrated in FIG. 3 according to a first embodiment of the invention.

In accordance with the present invention, the above problem has been eliminated by means of the arrangement illustrated in FIGS. 3 and 4. FIGS. 3 and 4 illustrate the support arrangement of the applicator beam 20 of the displaceable roll 14, i.e. the roll mounted on the loading arm 16 of the size press. It is important to note that a fully equivalent arrangement can also be accomplished on the applicator beam 20*a* at the side of the fixed roll 12. As described above, the applicator beam 20 is mounted pivotally, by means of the articulated joint 21, on the holders 24,44. The applicator beam 20 and the coating device 23 arranged thereon can be pivoted by means of the pivot cylinders 22 arranged between the coating position, i.e. the closed position, shown in FIG. 3 and the open position.

In the embodiments illustrated in FIGS. 3 and 4, lever-shaped catches 27,47 in a device in accordance with the invention are arranged on a wall 26 of the applicator beam 20 facing the roll 14 and in the area of each end of the applicator beam 20 in the direction of width of the machine. The catches 27,47 are linked to the wall 26 of the applicator beam by means of articulated joints 28,48 so that the lever-shaped catches 27,47 can pivot around the articulated joints 28,48.

At a first end of each of the lever-shaped catches 27,47, a cam 29,49 is formed. The cam 29,49 rests against a support 25,45 arranged on each holder 24,44 when the applicator beam 20 is in the closed position. Thus, by means of the holders 24,44 and the loading arm 16, the position of the supports 25,45 is fixed in relation to the bearing 15 of the roll 14. A connecting link 30,50 is arranged at the second end of each of the catches 27,47, i.e. at the opposite side of the articulated joint 28,48 with respect to the cam 29,49. By means of the connecting links 30,50, the catches 27,47 are interconnected by means of a pulling member, or connecting rod 35, which is preferably a rigid connecting rod as shown in the embodiment of FIG. 4.

Figure 5:
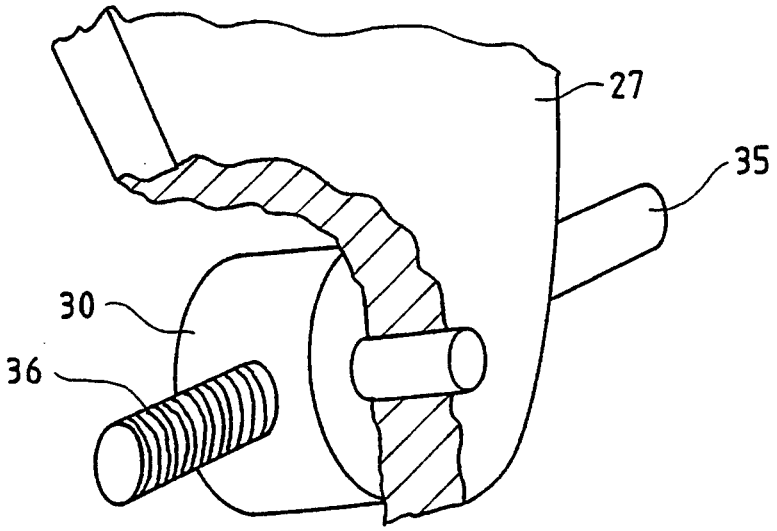
FIG. 5 is a further enlarged detail of the embodiment illustrated in FIG. 4.

One possible mode of linking the connecting link 30 with the catch lever 27 is illustrated in FIG. 5. In this embodiment, in a similar manner to the embodiment of FIG. 4, the articulation shaft of the connecting link 30 is parallel to the pivot shaft of the articulated joint 28 to thereby form a quadrangle between the articulated joints 28,48 and the connecting links 30,50.

As shown in FIG. 5, a through hole has been formed in each connecting link 30,50 which is perpendicular to the pivot shaft. An inside thread has been formed in the hole. In a corresponding manner, threaded parts 36,56 have been formed on the connecting rod 35 at the connecting links 30,50. The threaded parts 36,56 are of opposite handedness, so that, in the embodiment shown in FIG. 4, when the connecting rod 35 is rotated in one direction, the connecting links 30,50 can be made to approach one another while the catch levers 27,47 rotate around their articulated joints 28,48. In a similar manner, when the connecting rod 35 is rotated in the opposite direction, the connecting links 30,50 move apart from one another. By means of this arrangement, the pre-stress of the catches 27,47 of the applicator beam 20 can be adjusted by simply rotating the connecting rod 35.

The construction of the applicator beam 20 is very rigid with respect to rotation. Thus, in conventional support devices, it is possible for the size press to be configured as shown in FIG. 2, in which the contact is lost between the machine frame and one catch of the applicator beam 20.

However, in contrast to the conventional devices, in the device in accordance with the invention, it is possible to equalize the support forces produced by the pivot cylinders 22. This is achieved by placing the catches 27,47 at each end of the applicator beam 20 and interconnecting them by means of articulated joints in the manner in accordance with the invention. In such an embodiment, if the roll 14 has been placed diagonally as shown in FIG. 2, when the application beam 20 is being closed, a situation arises in which the cam 49 of the second catch 47 meets the support 45 on the holder 44 first. When this happens, the second catch 47 pivots around its articulated joint 48 and, at the same time, turns the first catch 27 by means of the connecting rod 35, so that the cam 29 of the first catch moves closer to the support 25 provided on the holder 24 and finally into contact with the support 25.

After the closing of the applicator beam 20 has been completed, both of the catches 27,47 are in contact with the supports 25,45 with a substantially equal support force. In this case, the support forces produced by the pivot cylinders 22 are equal at each end of the applicator beam 20. Thus, when the pivoting movement of the applicator beam has been completed, the beam is placed in its adjusted position in relation to the roll 14. The kinetic energy of the pivoting movement of the applicator beam 20 is absorbed by means of shock absorbers (not shown), but it is also possible to arrange the shock absorption means on the connecting rod 35 itself.

Figure 4A:
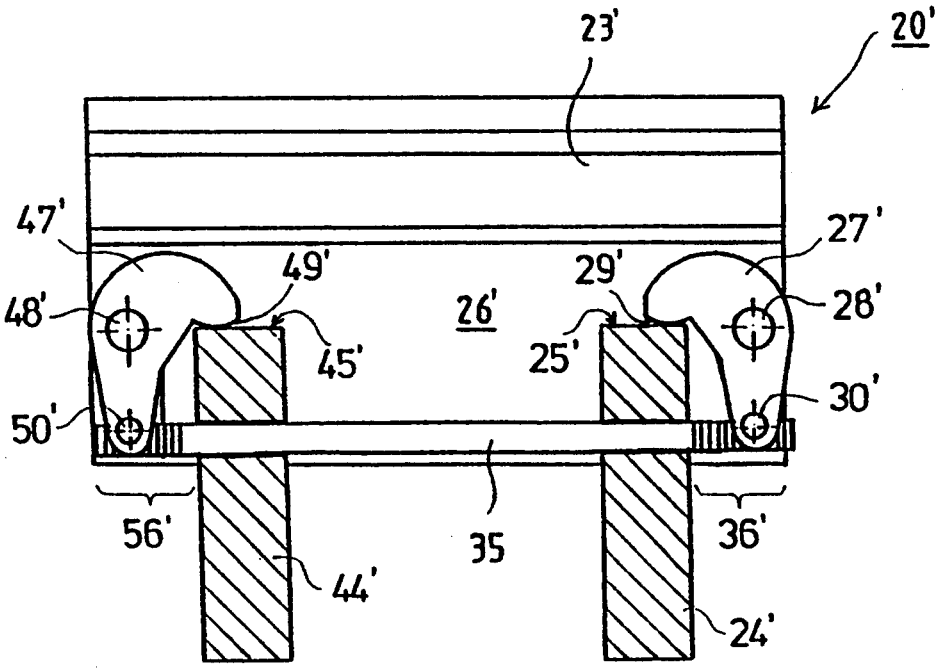

FIG. 4A shows an alternative embodiment to the embodiment shown in FIG. 4. The elements of the embodiment of FIG. 4A which are the same as the elements in FIG. 4 as described above, have been denoted with a prime notation, unless otherwise indicated. In the embodiment of FIG. 4A, the applicator beam is denoted with the reference numeral 20' and the coating device with the numeral 23'. Lever-shaped catches 27',47' are mounted as mirror images, when compared with the embodiment of FIG. 4, in relation to the vertical axes running through articulated joints 28',48'. An intermediate member 35' acts as the member that receives the compression force. Reference numerals 24',44' refer to the holders, and reference numerals 30',50' refer to the connecting links. The threaded parts of the intermediate member 35' are denoted with reference numerals 36',56' the cams of the catches 27',47' with reference numerals 29',49' and the supports on the holders 24',44' with reference numerals 25',45'. Reference numeral 26' refers to the wall of the applicator beam 20'.

In the embodiment of FIG. 4A, the member 35' that receives the compression force can be substituted for by a pulling member, such as a wire (not shown), which interconnects the connecting links (30',50') and passes, e.g., over reversing pulleys, which are placed outside the connecting links 30',50' in the direction of width of the applicator beam 20'.

Figure 6:
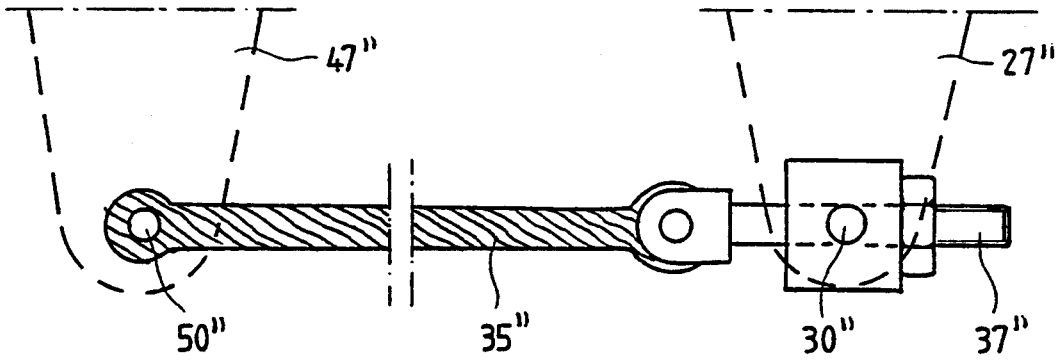
FIG. 6 shows an alternative embodiment to that shown in FIG. 4 of a device in accordance with the invention.

FIG. 6 shows a further alternative embodiment to the embodiment shown in FIG. 4. In FIG. 6, the dashed lines and reference numerals 27" and 47" represent the catch ends next to the connecting links. The connecting links are denoted in the figure with reference numerals 30" and 50". The embodiment shown in FIG. 6 differs from the embodiment of FIG. 4 in the respect that, in FIG. 6, the connecting rod 35 as shown in FIG. 4 has been substituted for by a wire 35" or by an equivalent flexible pulling member. Moreover, as is shown in FIG. 6, a length-adjusting device 37" is arranged at one end of the pulling member 35". By means of the length-adjusting device, it is possible to carry out the necessary regulation of the pre-stressing. In regard to the principles of operation, the embodiment of FIG. 6 is similar to the embodiment shown in FIG. 4. Thus, the wire 35" is provided with length-adjusting means to vary the relative distance between the connecting links 30",50" of the catches 27",47".

The examples provided above are not meant to be exclusive. Many other variations of the present invention would be obvious to those skilled in the art, and are contemplated to be within the scope of the appended claims.

We claim:

1. A device in a size press in which press rolls define a nip through which a paper or board web is passed, comprising a frame of a size press, a first press roll mounted on said frame, a second press roll mounted on said frame in nip-defining relationship with said first press roll, loading means for loading said second press roll, at least two applicator beams displaceably mounted adjacent said first and second press rolls, at least one of said of the at least two applicator beams having a first and second catch arranged at a first and second end thereof, respectively, means for connecting said first and second catches to each other for dependent positional adjustment of said first and second catches, said first and second catches being attached to said at least one applicator beam by means of articulated joints, coating means mounted on said at least one beam applicator transverse to a machine direction for spreading a coating agent onto said first and second rolls, and pivot cylinders arranged between said frame and said applicator beams for pivoting said applicator beams between a closed position adjacent a respective press roll and an open position away from the respective press roll.

2. A device in a size press in which press rolls define a nip through which a paper or board web is passed, comprising a frame of a size press, a first press roll mounted on said frame, a second press roll mounted on said frame and being displaceable by loading means, a nip being defined between said first and second press roll, coating means for spreading coating agent onto said first and second rolls, a respective applicator beam for supporting a respective one of said coating means for movement relative to said first and second press rolls, at least one of said applicator beams having a first and second catch arranged at a first and second end thereof, respectively, said first and second catches being mechanically connected to each other for dependent positional adjustment and attached to said at least one applicator beam by means of articulated joints and pivot cylinders arranged between said frame and said applicator beams for pivoting said applicator beams between a closed position adjacent a respective press roll and an open position away from the respective press roll.

3. The device of claim 2, wherein said applicator beams are supported on said frame or on said loading means.

4. The device of claim 2, wherein said at least one applicator beam comprises a wall arranged to face a respective roll, said articulated joints being connected to said wall.

5. The device of claim 2, wherein said first press roll is permanently mounted on said frame by means of bearings.

6. The device of claim 2, wherein said coating devices are mounted on said applicator beams transverse to a machine direction.

7. The device of claim 2, further comprising bearings, said second press roll being mounted on said frame by means of said bearings, supports rigidly connected to said bearings of said second press roll, and means to connect said first and second catches of said at least one applicator beam, each of said first and second catches comprising a lever linked with said at least one applicator beam by means of one of said articulated joints, and a cam arranged at a first end of said lever such that said cam is supported during the movement of said at least one applicator beam to the closed position adjacent a respective one of said supports, said means being arranged to connect said first and second catches at a second end of said lever opposite to said first end of said lever.

8. The device of claim 7, wherein said articulated joints are arranged in a middle portion of said lever between said first end and said second end of said lever.

9. The device of claim 7, wherein said supports are arranged between said first and second catches.

10. The device of claim 7, wherein said loading means comprise a loading arm.

11. The device of claim 10, further comprising holders attached to said loading arm, said supports being arranged on said holders.

12. The device of claim 7, wherein said means comprise an intermediate member.

13. The device of claim 12, wherein said intermediate member is a structured and arranged to receive a compression force.

14. The device of claim 12, further comprising connecting links to connect said intermediate member to said levers at said second end thereof, said connecting links having pivot shafts arranged parallel to said articulated joints to form a quadrangle between said articulated joints and said connecting links.

15. The device of claim 14, wherein said connecting links are arranged on said catches, and said intermediate member is adjustable to change the relative distance between said connecting links.

16. The device of claim 14, wherein said intermediate member comprises a connecting rod, said connecting rod being provided with threaded parts arranged at a first and second end thereof in proximity to said connecting links, said threaded part on said first end of said connecting rod having an opposite handedness than said threaded part on said second end of said connecting rod such that said connecting links approach each other when said connecting rod is rotated in one direction and said connecting links move apart from one another when said connecting rod is rotated in an opposite direction, said connecting links having internally threaded holes corresponding to said threaded parts of said connecting rod, the axial direction of said internally threaded holes being perpendicular to said pivot shafts of said connecting links.

17. The device of claim 14, wherein said intermediate member is a pulling member.

18. The device of claim 17, wherein said pulling member is a wire having length-adjusting means such that the relative distance between said connecting links of said catches is variable.

19. The device of claim 17, wherein said pulling member is an equivalent flexible member having length-adjusting means such that the relative distance between said connecting links of said catches is variable.

* * * * *